United States Patent [19]

Schreck et al.

[11] 4,260,126

[45] Apr. 7, 1981

[54] APPARATUS FOR IN-SITU PRODUCTION OF CONCRETE SLABS

[76] Inventors: Philipp Schreck, Langbürgenerstrasse 2/13, 8 München 90; Gerold A. Buck, Trollingerweg 39, 7050 Waiblingen, both of Fed. Rep. of Germany

[21] Appl. No.: 99,999

[22] Filed: Dec. 4, 1979

Related U.S. Application Data

[62] Division of Ser. No. 932,403, Aug. 9, 1978.

[30] Foreign Application Priority Data

Aug. 12, 1977 [DE] Fed. Rep. of Germany ..... 2736524

[51] Int. Cl.[3] ..... E04G 11/20

[52] U.S. Cl. ..... 249/20; 425/63

[58] Field of Search ..... 264/33, 34; 425/63–65; 249/20

[56] References Cited

U.S. PATENT DOCUMENTS

| | | | |
|---|---|---|---|
| 3,985,480 | 10/1976 | Finsterwalder | 425/63 |
| 3,989,218 | 11/1976 | Muller | 264/33 X |
| 4,103,861 | 8/1978 | Buchler | 425/63 X |
| 4,123,031 | 10/1978 | Hyre | 249/25 X |

*Primary Examiner*—Thomas P. Pavelko

*Attorney, Agent, or Firm*—Hill, Van Santen, Steadman, Chiara & Simpson

[57] ABSTRACT

Apparatus is provided for production of concrete slabs wherein a reinforced elongated concrete slab is progressively formed on longitudinal supports following the installation of the supports by mounting carriages for movement along the length of the supports, providing the carriages with a leading platform portion to facilitate construction of a metal rod reinforcement core spanning the supports and a trailing slab forming platform. A reinforcing core is built up on the leading platform, a concrete slab is cast around a previously formed core on the trailing platform, the core built-up on the leading platform is suspended from the supports, and after the concrete has set sufficiently to provide a self-sustaining reinforced slab, the platforms are lowered, the carriages are advanced to position the trailing forming platform under the suspended reinforced core with the leading platform spanning the supports ahead of the core, the platforms are raised to the desired level for casting a continuation of the slab and for forming a continuation of the reinforcing core and the core forming and concreting steps are repeated. The apparatus is especially useful for forming the carriageway or road on bridges. The platforms may be suspended from below or above the tops of the supports and a cantilever C-shaped suspension may be provided for a slab portion, such as a walkway, extending laterally beyond an outer support.

8 Claims, 6 Drawing Figures

APPARATUS FOR IN-SITU PRODUCTION OF CONCRETE SLABS

This is a division of application Ser. No. 932,403, filed Aug. 9, 1978.

FIELD OF THE INVENTION

This invention relates to the art of forming reinforced concrete slabs on longitudinally extending elevated supports and particularly deals with the in-situ step-by-step forming of reinforced concrete carriageways or road beds on transversely spaced longitudinally extending girders supported on elevated pedestals such as are conventionally used for bridges and elevated roadways. The invention involves the construction and use of concrete shaping or forming platforms and advanced metal rod reinforcement core supporting platforms which can be advanced step-by-step as the work progresses to reduced costs and expedite concrete road and bridge building.

PRIOR ART

In the production of in particular the carriageway slab of a bridge structure which is concreted onto prefabricated longitudinal girders it is usual to construct formwork bases supported on the longitudinal girders on which the slab reinforcement is mounted and thereafter the section provided with the slab reinforcement is concreted. The formwork is then removed again. This sequence of work steps is then repeated for each slab section to be made in-situ concrete. This method of working has several disadvantages, one of which is that the work gangs fitting the sectional reinforcement or concreting the slab section because of their specialization in the one or other activity cannot be employed continuously but each have long waiting periods during which they cannot be used for their specific activity. These waiting times may be eliminated by erecting the formwork bases correspondingly over a plurality of slab sections to be concreted so that the work gang occupied with making the slab reinforcement can continue to work also during the concreting and setting of the concrete. Even when attempts are made to prefabricate parts of the slab reinforcement at another location to offset the waiting times, it is found that this is not advantageous because due to the intense interlacing of the slab reinforcement the integration of prefabricated parts is very time-consuming.

A further disadvantage arising necessarily with the erection of the slab reinforcement on the formwork base is that the soiling of the formwork base inevitable during the reinforcement work must be removed again after making the slab reinforcement. This cleaning of the formwork base through the reinforcement is usually done by blasting but this does not guarantee that the formwork base is adequately cleaned to avoid impurities occurring at the concrete surface in the case of exposed concrete.

A further disadvantage of a slab reinforcement of conventional nature disposed on a formwork base is that the reinforcement is relatively yieldable and is displaced or bent under the load of the work gangs moving around thereon, particularly prior to and during the concreting. This changes the static conditions and as a result the reinforcement is made thicker than actually required by the static conditions.

SUMMARY OF THE INVENTION

Since in particular when making bridge structures the carriageway slab concreted onto the prefabricated longitudinal girders is concreted over the entire width it is desirable to be able to adapt the concreting of the carriageway slab to the working cycle of making the longitudinal girders to rationalize the production of the bridge structure. It is particularly desirable for the advancing of the production of the longitudinal girders to take place in time with the production of the slab reinforcement and the concreting of the carriageway slab.

The invention is thus based on the problem of providing means with which the section-wise production of an in-situ concrete slab can be adapted to the section-wise production of the longitudinal girders and this may be done in identical repetitive steps, the bases on which on the one hand the slab reinforcement is built up and on the other the in-situ slab is concreted being each used only for one of these two purposes.

This problem is solved by apparatus for the section-wise production of an in-situ slab concreted onto prefabricated longitudinal girders with reinforcement bases displaceable in repetitive steps in the longitudinal direction and adjoining formwork base, which are vertically adjustable, that during a repetitive step simultaneously a section of a self-supporting slab reinforcement is placed on the reinforcement base and on the formwork base the reinforced slab section of the preceding repetitive step is concreted, and that thereafter the formwork base is moved beneath the last completed slab reinforcement supported in self-supporting manner on the longitudinal girders and the reinforcement base is moved into the following free span section. Using this apparatus it is possible in advantageous manner, simultaneously in one and the same cycle step, which is adaptable to that of the production of the longitudinal girders, both to make up the plate reinforcement and to concrete the reinforced section, the displacement of the reinforcement base and of the formwork base through one section in each case ensuring in the concreting of the in-situ concrete slab that a formwork base is always used on which there are no residues originating from the reinforcement work. This moving of the reinforcement base and of the formwork base is possible because the slab reinforcement is statically self-supporting so that during the moving away of the reinforcement base and the pushing under of the formwork base it may be supported in statically self-supporting manner as substantially non-flexible reinforcement structure on the longitudinal girders.

According to a further development, during each repetitive step (a) the reinforcement base is brought after movement into a free span section to a working level suitable for erecting a statically self-supporting slab reinforcement supported on the longitudinal girders, the slab reinforcement made and thereafter vertically adjusted to a suitable level for renewed displacement; (b) the formwork base is moved beneath the slab reinforcement finished in the previous repetitive step and supported in cantilever manner on the longitudinal girders and is raised to a level suitable for concreting, the slab section concreted and after setting of the concrete lowered for renewed displacement.

In this embodiment the formwork base and the reinforcement base are made displaceable and vertically adjustable independently of each other. This facilitates the displacement of the formwork base and the reinforcement base. It is further thus possible to lower the reinforcement base and the formwork base for the displacement so that they are completely freely displaceable and thereafter again raise them to levels which are desirable or necessary in the case of the reinforcement base for the production of the reinforcement and in the case of the formwork base for the concreting.

The invention provides a formwork base and a reinforcement base in such a manner that the formwork and reinforcement base disposed between the longitudinal girders is divided into moving bases supported independently of each other on the lower flanges of the longitudinal girders via carriages, and the carriages are provided with lifting spindles for lowering and raising the formwork and reinforcement bases.

The division into a separate formwok base and a separate reinforcement base facilitates displacement and adaptation to the operating condition optimum for the particular activity. The lowering of the two bases on the lifting spindles guarantee a reliable location for the displaceable bases.

As further development of the formwork and reinforcement base for the footpath cantilevering, the formwork and reinforcement bases disposed outside the outermost longitudinal girders consist of a truss platform which is suspended at the rear end via a C-shape bracket on a carriage moveable on the already concreted in-situ concrete slab and which is suspended at the front end on a transverse crossbeam moveable on the longitudinal girders, that the lower side of the truss platform is supported via support beams and possibly carriages or lifting spindles or wedges on the lower flange of the outer longitudinal girders, that the carriages for lifting and lowering the truss platform are provided with lifting spindles, and that the truss platforms are slightly laterally displaceable at their suspension.

With such a truss platform the reinforcement and concreting work at the footpath cantilevering may also be carried out in accordance with the invention in simple manner, ensuring that the reinforcement is laid cleanly under conditions meeting the static requirements and the possibility of walking thereon during the erection of the reinforcement as well as during the concreting in the region of the footpath cantilevering and that said working operations may be carried out on the outer platforms in time with those on the intermediate platforms.

A further development is considered expedient in which on the truss platform independently vertically adjustable planes are formed as formwork base and reinforcement base in order to adjust the bases independently of each other to an optimum working level during the individual operations.

The crossbeam provided for suspending the truss platform may extend over the entire width of the structure and at each side carry the front portion of a truss platform. It is however also possible for the crossbeam to extend only over two longitudinal girders and carry a compensating weight at the end opposite the truss platform.

The slab reinforcement provided according to the invention, in which reinforcement rods extending transversely and longitudinally of the longitudinal girders are used which are connected together at intersections, spacer brackets being disposed between reinforcement rods extending as upper chord and lower chord, is distinguished according to the invention in that the slab reinforcement is provided with stiffening beams arranged transversely of the longitudinal girders and supported on the latter which are in spaced adjacent relationship such that in conjunction with the bending stiffness of the reinforcement elements extending parallel to the longitudinal beams a self-supporting slab reinforcement is formed.

This form of the slab reinforcement provides a statically self-supporting reinforcement which does not appreciably bend when the reinforcement base is moved away and the formwork base driven beneath. During this movement of the bases the self-supporting slab reinforcement is supported in cantilever manner only on the longitudinal girders. The use of the stiffening beams and the reinforcement elements determining the rigidity do not from the statical point of view represent an appreciable additional expenditure of reinforcement iron but permits due to the stiffening the use of thinner reinforcement irons at locations at which for statical reasons stronger reinforcement were hitherto used but only to prevent a bending of the reinforcement when walked on. The stiffening of the slab reinforcement according to the invention provides on the whole a stiffer reinforcement form which even with relatively thin reinforcement irons permits walking on thereof without appreciable displacement or bending of the reinforcement. Thus, with the slab reinforcement according to the invention subsequent operations are avoided which are generally necessary for compensating the bending of the reinforcement when walked on prior to concreting.

According to a further development of the slab reinforcement the stiffening beams consist of a transversely extending upper and lower chord which are connected to a reinforcement rod which is diagonally continuous and extends up and down at the buckling points thereof (chassis truss).

This stiffening beam may also be stiffened by rectangular brackets secured at the upper and lower chords (vierendeel truss).

If the slab reinforcement itself represents a relatively stiff reinforcement due to the static requirements, but is not self-supporting, according to a particularly advantageous further development of the invention the stiffening beams consist of stiffening crossbeams which extend over the slab reinforcement and are supported on the longitudinal beams, on which the slab reinforcement is suspended.

This embodiment makes it possible to recover the stiffening beams because the suspension of the slab reinforcement is only necessary when the reinforcement base is removed from beneath the slab reinforcement and the formwork base moved beneath. When the formwork base is disposed beneath the finished slab reinforcement the latter is deposited on the formwork base in the usual manner employing spacers and consequently a self-supporting non-flexibility is not required. Accordingly, after depositing the slab reinforcement on the formwork base the stiffening crossbeam may be removed and used again.

The invention is not restricted only to the features indicated provided that with the aid of a substantially non-sagging slab reinforcement supported on the longitudinal girders the possibility is created of removing the reinforcement base provided for making the slab reinforcement and replacing it by the formwork base on which the in-situ concrete slab is concreted.

The advantages and features of the invention will be apparent from the following description of the examples of embodiment in conjunction with the claims and drawings, wherein:

Figure 1:
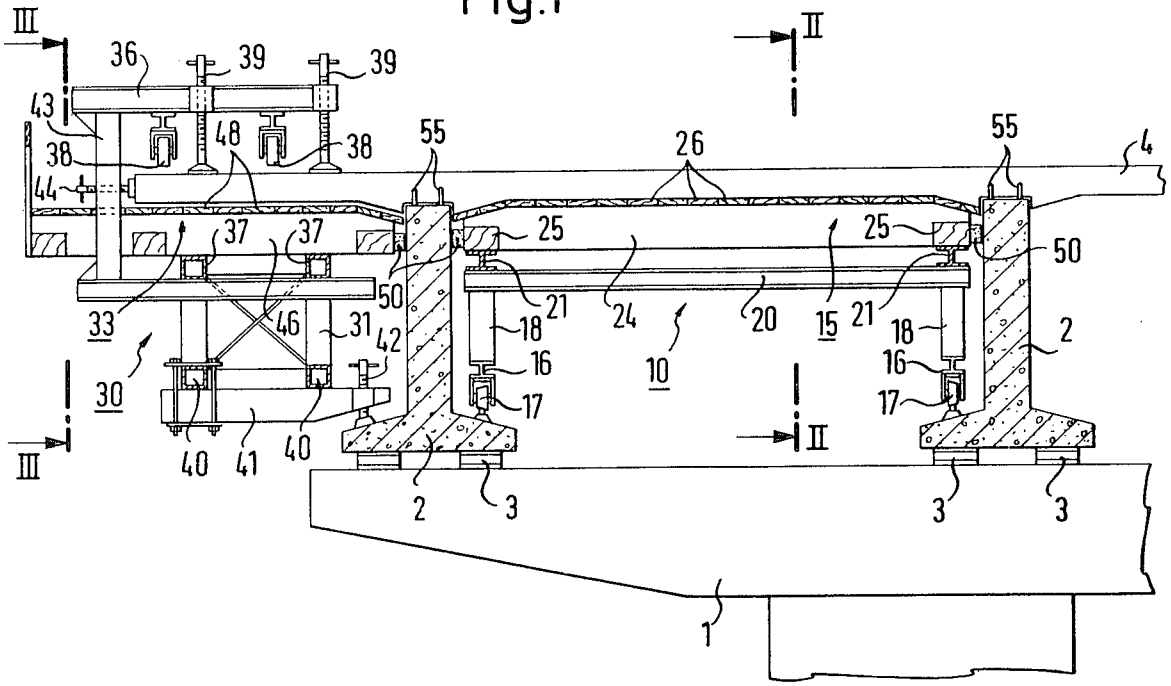
FIG. 1 is a partial transverse section through a bridge structure along the line I—I of FIG. 3 in which can be seen an inner platform and an outer truss platform for making an in-situ concrete slab according to the invention.
Figure 2:
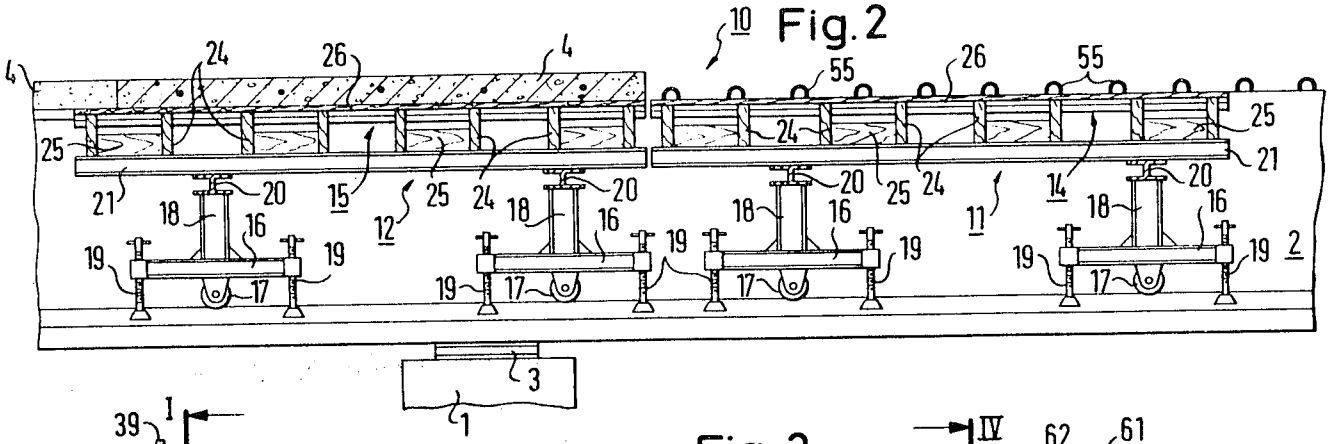
FIG. 2 is a longitudinal section along the line II—II of FIG. 1 which shows the reinforcement base and the formwork base of the internal platform.

The figures represent the realization of the invention in making an in-situ concrete carriageway slab of a bridge structure on predetermined longitudinal beams.

The prefabricated longitudinal girders 2 of the bridge are deposited on transverse yokes such as 1 with interposition of rubber mountings 3. The in-situ concrete carriageway slab 4 extends above said longitudinal girders. The longitudinal girders 2 bridge the span between at least two supports which merge into the transverse yoke. These longitudinal girders are made spanwise, two or more longitudinal girders extending parallel adjacent each other depending on the width of the bridge structure.

For economy reasons it is desirable to make the in-situ concrete carriageway slab directly following the spanwise completion of the longitudinal girders in timed rhythm such that for erecting the longitudinal girders in a span the same time is required as for making the in-situ concrete carriageway slab in the following span. To achieve such a working rhythm economically it is necessary for work gangs intended to perform certain operations to repeat immediately following each other the same operations in succession. This is achieved with the aid of the invention by the work steps and the formwork and reinforcement bases using a self-supporting slab reinforcement. These formwork and reinforcement bases consist between the longitudinal girders 2 of the inner platform 10 which consists of a reinforcement platform 11 and a formwork platform 12. In the embodiment illustrated the reinforcement platform and the formwork platform are made up separately. It is however alternatively possible for the two platforms to be connected together and not operated independently of each other.

The reinforcement platform 11 and the formwork platform 12 are made fundamentally identical and consist of a reinforcement base 14 which is supported and moveable on carriages 16. Correspondingly, the formwork base 15 is supported on carriages 16 which are displaceable on the lower flange of the longitudinal girders with the aid of rollers 17. The rollers 17 are disposed on the lower side of a support beam on whose upper side supports 18 are disposed. At the two side ends of the support beam lifting spindles 19 are arranged with which the carriage 16 can be raised and lowered.

The supports 18 of two opposite carriages 16 of the inner platform are connected with a crossbeam 20. Above the crossbeams of the reinforcement platform and the formwork platform longitudinal beams 21 extend on which the reinforcement base 14 and the formwork base 16 are supported. Both the reinforcement base 14 and the formwork base 15 are made identically although the formwork base must take up a considerably greater weight.

In the embodiment illustrated, a wood structure has been chosen for both the reinforcement base and the formwork base and consists of planks 24 extending transversely over the longitudinal beams 21, adjacent pairs of which are held in their perpendicular position by wooden spacers 25. The planks are cut at the top corresponding to the desired shape and carry boards 26 extending in the longitudinal direction of the structure which are closely adjacent each other and in a closed area fill the space between the longitudinal girders 2.

By providing lifting spindles 19 on the carriages 16, the reinforcement base and the formwork base may be raised and lowered to the desired working level and the travelling level.

The dimension of the reinforcement platform 11 and the formwork platform 12 in the longitudinal direction of the structure corresponds preferably in each case to the longitudinal width of a concreting section in the production of the in-situ concrete carriageway slab.

Figure 3:
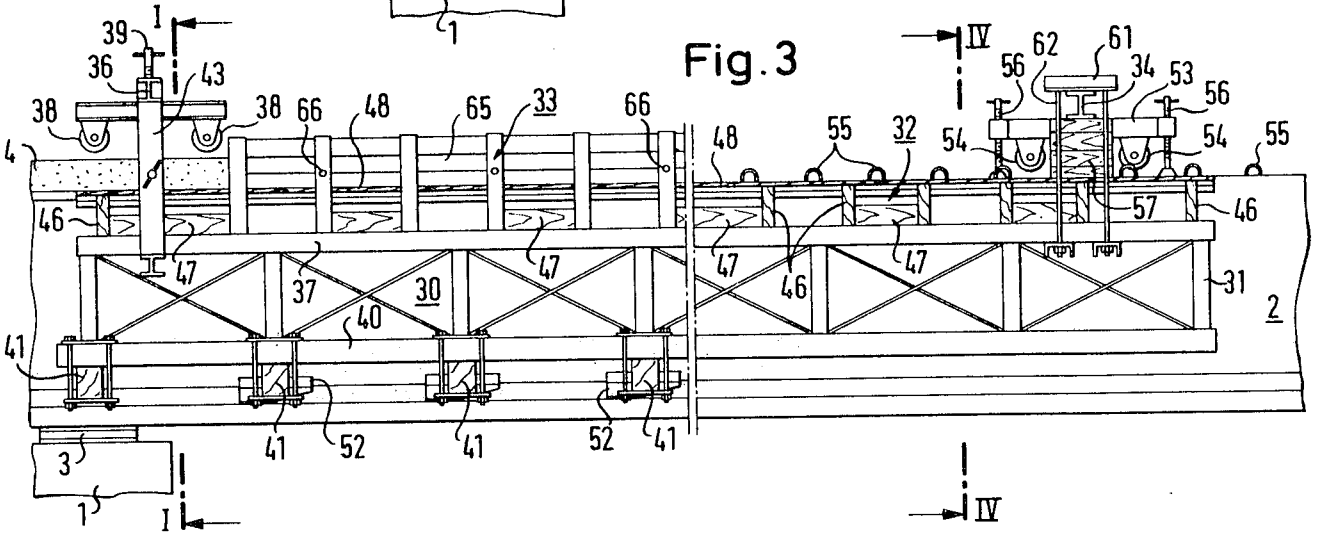
FIG. 3 is a longitudinal section along the line III—III of FIG. 1 from which the outer truss platform used as reinforcement base and as formwork base can be seen.
Figure 4:
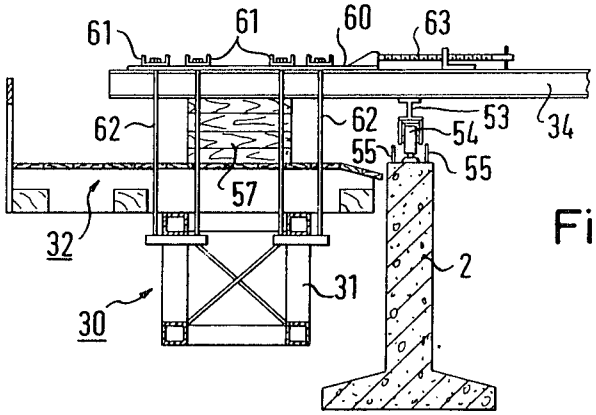
FIG. 4 is a transverse section along the line IV—IV of FIG. 3 which shows the front suspension of the outer lifting platform on a crossbeam.

An outer truss platform 30 illustrated in FIGS. 1, 3 and 4 serves for the reinforcing and concreting of the part of the carriageway slab associated with the footpath cantilevered structure. This truss platform consists of a spatially torsion-stiff truss 31 on which the reinforcement base 32 and the formwork base 33 rest. The truss 31 is suspended with its rear end at the already finished carriageway slab 4 and at its front end at a crossbeam 34 longitudinally moveable on the longitudinal girders.

In the embodiment illustrated the reinforcement base and the formwork base are not independently vertically adjustable because of the continuous truss 31, although such an embodiment is possible but is not described. Between the reinforcement base and the formwork base and the truss lifting means are provided which permit an independent vertical adjustment of the reinforcement base and the truss base.

The suspension of the truss 31 at the rear end consists of a C-shaped support bracket 36 which with one leg engages beneath the upper strut 37 of the truss and is supported with the leg engaging over the carriageway slab by means of rollers 38 on the carriageway. Apart from the rollers, on the same leg lifting spindles 39 are provided with which the truss 31 may be raised and lowered. The lifting spindles also engage on the surface of the already completed carriageway slab. At the lower struts 40 of the truss 31 support beams 41 are secured which engage over the flange of the adjacent longitudinal girder 2 and are supported with lifting spindles 42 on the flange of the adjacent longitudinal girder 2. The torsion moment arising from this supporting on the flange of the longitudinal girder is taken up by tension rods, not illustrated, which extend transversely through the slab reinforcement and are thus concreted in. These tension rods project laterally at the end faces of the carriageway slab and are fixedly connected to the vertical end formwork of the carriageway slab. This connection is not illustrated in the drawings.

At the perpendicular bracket 43 a further spindle 44 is disposed which may be placed against the end face of the carriageway slab. The purpose of this spindle 44 will be apparent from the following description.

The formwork base or reinforcement base made up on the truss 31 is constructed in the same manner as in the inner platform and consists of perpendicular planks 46 which are connected together by wooden spacers 47 and held in the vertical position. The upper edge of the planks is adapted to the desired profile and covered with boards 48. At the side of the formwork base facing the web of the longitudinal girder 2, rubber strips 50 may be arranged which effect a sealing so that during the concreting the web of the longitudinal girder is not soiled by liquid running down.

The reinforcement base and the formwork base is continued on the outside so that a catwalk is formed which extends over the entire length of the truss.

As apparent from FIG. 3, not all the support means 41 are supported with the aid of spindles against the lower flange of the longitudinal girder. On the contrary, these spindles are used only at the front and rear ends and possibly in the middle. The remaining support beams suspended on the truss 31 are wedged on the flange of the longitudinal girder with the aid of wedges 52 for transmitting the force.

The front suspension of the truss 31 is illustrated in FIG. 4. The crossbeam 34 extends over at least two longitudinal girders 2 (only one being shown) and is displaceable thereon with the aid of a carriage 53. The rollers 54 of said carriage run between the reinforcement irons 55 projecting out of the upper edge of the longitudinal girder and are mounted on a carriage beam to the outer ends of which lifting spindles 56 are attached (FIG. 4). With the aid of the lifting spindles, the carriage and thus the crossbeam 34 and the truss 31 may be raised and lowered.

The truss 31 and with it the reinforcement base 32 is screwed to the crossbeam, planks being interposed for adjusting the correct spacing.

The crossbeam 34 extends over at least two longitudinal girders and on both sides the front ends of the outer truss platform may be suspended. In this embodiment both outer truss platforms are simultaneously displaced. It is also possible for the crossbeam 34 to be supported only on two longitudinal girders and to carry on the side opposite the truss, ballast for weight compensation.

On the upper side of the crossbeam 34 a slide plate 60 is disposed which is connected to the mounting rails 61 at which via tension rods 62 the truss with the reinforcement base is suspended. This sheet metal slide plate 60 is reciprocally displaceable in the longitudinal direction with the aid of a spindle 63 which is mounted on the crossbeam 34.

The purpose of the displacement of the slide plate 60 with the aid of the spindle 63 is to remove the truss and the reinforcement base connected thereto slightly from the web of the longitudinal girder. For the same purpose the spindle 44 is provided at the perpendicular bracket 43 of the rear suspension and with it the rear suspension may be pressed slightly outwardly so that the formwork base becomes free of the web of the longitudinal girder. This slight outer displacement of the truss is intended to ensure that the reinforcement base and the formwork base after the lowering of the carriages onto the rollers 38 and 54 and the slight outward displacement with the aid of the spindles 44 and 63 hang freely and are easily moveable.

FIG. 3 further illustrates the lateral formwork base 65 which serves for the lateral limitation of the carriageway slab during concreting. Arranged at said lateral formwork base are bores 66 through which the already mentioned tension rods extend which are anchored to the lateral formwork base in order to take up the transverse forces occurring during concreting.

Figure 5:
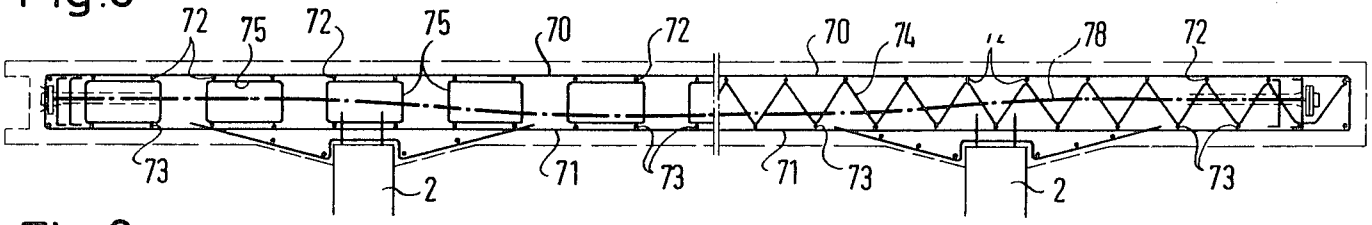
FIG. 5 is a transverse section through a self-supporting slab reinforcement supported on longitudinal girders in accordance with the invention in which the stiffening beams are disposed within the reinforcement construction.
Figure 6:
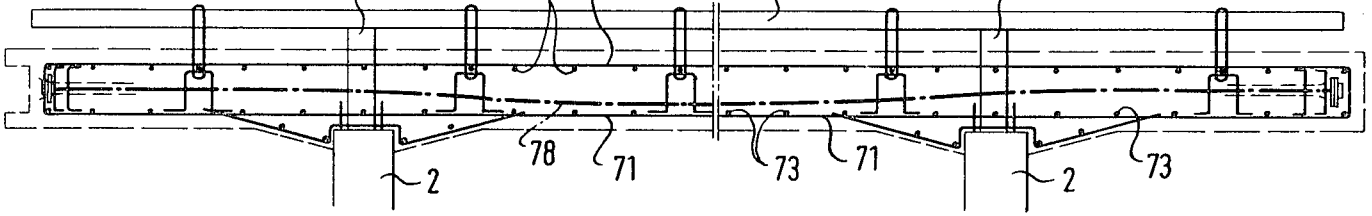
FIG. 6 is a transverse section through a slab reinforcement in which the stiffening beams are disposed above the reinforcement structure.

In FIGS. 5 and 6 embodiments of the slab reinforcement are illustrated as may be used according to the invention. According to FIG. 5 the slab reinforcement has transversely extending upper chords 70 and transversely extending lower chords 71 which are connected to longitudinally extending upper chords 72 and longitudinally extending lower chords 73.

To stiffen the reinforcement structure in the transverse direction, upper and lower chords extending parallel to each other are connected at predetermined intervals by a diagonally upwardly and downwardly extending reinforcement rod 74 of the embodiment of a stiffening beam illustrated on the right-hand side of FIG. 5, the buckling points of the diagonal rods being connected in suitable manner to the longitudinally extending and transversely extending upper chords.

The embodiment of the stiffening beam illustrated in FIG. 5 on the left-hand side employs for stiffening instead of diagonal rods rectangular brackets 75 which are also connected to the transversely and longitudinally extending upper and lower chords. The stiffening beams extend adjacent each other in the slab reinforcement spaced apart such that in conjunction with the non-flexibility of the reinforcement members provided parallel to the longitudinal girders or the longitudinally extending upper and lower chords a self-supporting slab reinforcement is formed. Since the longitudinally extending upper and lower chords have a certain intrinsic stiffness it may be adequate for the stiffening beams to extend parallel to each other at a relatively small distance apart in order to obtain the necessary flexural strength in the longitudinal direction of the bridge structure as well.

As also indicated in FIG. 5, transverse stretching members 78 extend transversely through the slab reinforcement and are secured with the aid of spacers both at the upper chords and at the lower chords and due to their intrinsic stiffness contribute to the stiffening of the slab reinforcement.

Such slab reinforcements have enough flexural strength to retain position when the reinforcement base is lowered and moved away so that the former base can be pushed beneath the slab reinforcement and raised to the level intended for the lower edge of the concrete. The slab reinforcement rests on the formwork base with its spacers arranged at the lower chords.

FIG. 6 illustrates a further embodiment of the slab reinforcement according to the invention in which the necessary stiffness is obtained by a stiffening beam 80 extending over the slab reinforcement with which the reinforcement structure is connected. The structure of the slab reinforcement with upper and lower chords and the stressing members secured thereon with spacers corresponds substantially to the embodiment according to FIG. 5 and is of conventional construction. The reinforcing beams 80 extending parallel across the slab reinforcement are supported with the aid of supports 81 on the upper edge of the longitudinal girders 2 and carry the slab reinforcement suspended thereon when the reinforcement base is removed.

When the formwork base has been brought beneath the slab reinforcement and brought to the level suitable for concreting the slab reinforcement settles on the formwork base so that the stiffening beams 80 and the supports 81 may now be removed before the section of the carriageway slab is concreted. In this manner it is possible to stiffen even conventional slab reinforcements during the moving of the reinforcement base to such an extent that they do not sag in the freely suspended state and the moving of the reinforcement base or formwork base is possible. The stiffening beams 80 and the supports can be used repeatedly.

Although the invention has been described above only for the production of an in-situ concrete carriageway slab of a bridge structure concreted onto prefabricated longitudinal girders it is obvious that the features of the invention can also be applied to making any in-situ concrete slabs or pillars or supports. Such in-situ concrete slabs may be intermediate floors of buildings above and below ground of any type and it is not necessary for the reinforcement platforms to be displaceable only in one direction. In such floors the in-situ concrete slab may consist of rectangular or square adjoining slab elements which are supported on supports and mate with other slab elements on all sides on the same plane. In these uses as well it is readily possible to adjust the cycle procedure so that the time necessary for making the reinforcement structure and for concreting and setting of the concrete is substantially the same so that work gangs specialized in specific operations can be optimally employed.

We claim as our invention:

1. Apparatus for effecting the step-by-step production of a reinforced concrete slab bridging a span between and supported on transversely spaced permanent elevated longitudinally extending girders and the like supports which comprises carriages supported on and moveable along the length of said supports, a concrete shaping platform and a reinforcing core platform supported on said carriages spanning the space between the transversely spaced supports, and means for raising and lowering said platforms to accommodate simultaneous pouring of concrete around a previously built reinforcing core and building of an extension of the core in advance of the concrete.

2. The apparatus of claim 1 wherein the supports have lateral foot portions below the platform and the carriages are supported on said foot portions.

3. The apparatus of claim 2 including spindles supported on the foot portions for raising and lowering the platforms.

4. Apparatus for forming a reinforced concrete slab bridging a span between and supported on transversely spaced permanent elevated longitudinally extending girders which comprises a platform for supporting and shaping the concrete slab, a platform for supporting metal rods in the fabrication of a metal reinforcing core for the slab positioned in front of the shaping platform, a truss support under said platforms, a C-shaped bracket secured to said truss support and extending upwardly therefrom to a level above the concrete slab to be formed, a carriage suspended from said C-shaped bracket moveable along a previously formed concrete slab, a crossbeam above the girders, carriages riding on said girders supporting said crossbeam, and means suspending the forward end of the truss beam from said carriage supported crossbeam whereby the shaping and core material supporting platform are supported laterally of a girder from a previously formed concrete slab and from the tops of adjacent girders.

5. The apparatus of claim 4 including means for raising and lowering said C-shaped bracket and said crossbeam.

6. The apparatus of claim 4 wherein the crossbeam extends only over two adjacent longitudinal girders and a weight is provided at the end thereof opposite the truss beam to compensate the load thereon.

7. Apparatus for forming a concrete slab on top of transversely spaced longitudinally extending girders having laterally extending feet portions on both the inner and outer sides thereof which comprises carriages riding on the inner sides of said lateral feet portions, a leading reinforcing core platform supported on said carriages, a trailing concrete slab shaping platform supported on said carriages, lifting spindles on said carriages engageable with the inner sides of said lateral feet portions raising and lowering said platforms and anchoring the carriages in fixed positions when the platforms are raised, a C shaped bracket having legs overlying and underlying a concrete slab formed on said girders, a trailing concrete shaping platform supported on said underlying leg, a leading reinforcing core platform supported on said underlying leg, additional lifting spindles supported on said outer side of the foot of an adjacent girder raising and lowering said bracket, rollers on said overlying leg riding on a cured span of a previously poured concrete slab to move the bracket and platforms carried thereby to new positions when the additional spindle means lower said bracket, and further additional spindles on said overlying leg engageable with said cured span of the previously poured concrete slab to cooperate with said additional spindles supported on the outer side of the foot of the girder to raise the rollers off of the span and to support the bracket.

8. The apparatus of claim 7 wherein the platforms supported from the carriages on the inner sides of the lateral feet portions form a central reinforced concrete span between the girders and the platforms supported from the C shaped bracket form a reinforced concrete span extending laterally beyond a girder and merged with the central span.

* * * * *